United States Patent [19]

Lee

[11] Patent Number: 4,563,160

[45] Date of Patent: Jan. 7, 1986

[54] LIGHTING SYSTEM FOR ROTATABLE TOY

[76] Inventor: William B. Lee, 252 S. 800 East, Salt Lake City, Utah 84102

[21] Appl. No.: 588,071

[22] Filed: Mar. 9, 1984

Related U.S. Application Data

[63] Continuation-in-part of Ser. No. 373,427, Apr. 30, 1982, Pat. No. 4,435,917.

[51] Int. Cl.[4] ..... A63H 27/00; A63H 1/24; A63H 33/26

[52] U.S. Cl. ..... 446/47; 446/242; 446/485

[58] Field of Search ..... 446/34, 46, 47, 48, 446/61, 66, 242, 431, 438, 439, 484, 485; 307/119, 120; 340/671

[56] References Cited

U.S. PATENT DOCUMENTS

| | | | |
|---|---|---|---|
| 2,739,419 | 3/1956 | Cleveland | 446/242 |
| 2,836,009 | 5/1958 | Wang | 446/242 |
| 3,162,979 | 12/1964 | Garoogian | 446/242 |
| 3,812,614 | 5/1974 | Harrington | 446/47 |
| 4,282,680 | 8/1981 | Zaruba | 446/485 X |
| 4,282,681 | 8/1981 | McCaslin | 446/484 |
| 4,435,917 | 3/1984 | Lee | 446/47 |

*Primary Examiner*—Robert A. Hafer
*Assistant Examiner*—D. Neal Muir
*Attorney, Agent, or Firm*—Robert R. Finch

[57] ABSTRACT

A circuit for controlling lamp flash interval and duration which comprises an NE555 integrated circuit in combination with resistances and capacitances. In the circuit, a resistor and a capacitive switch in series therewith govern flash interval. The capacitive switch includes a normally closed centrifugal switch which, when closed, presents a given capacitance in series with the resistor and when open presents a reduced capacitance in series with the resistor. The capacitance is provided by two capacitors. In one embodiment, when the switch is closed, one capacitor is in series with the resistor and the other is bypassed and when the switch is open, both capacitors are in series with each other and with the resistor. In the other embodiment, when the switch is closed, the two capacitors are parallel with each other and in series with the resistor and when the switch is open, one of said parallel capacitors is bypassed.

7 Claims, 5 Drawing Figures

LIGHTING SYSTEM FOR ROTATABLE TOY

FIELD AND BACKGROUND OF THE INVENTION

This is a continuation-in-part of my earlier co-pending application Ser. No. 373,427 filed Apr. 30, 1982 for Lighting System For Rotatable Toy, now U.S. Pat. No. 4,435,917 issued Mar. 13, 1984.

This invention relates generally to lighting systems for rotating toys and in particular to a light flashing circuit for a so-called "flying saucer" toy.

The well known flying saucer toy is simply a lightweight disc having aerodynamic characteristics enabling it to travel considerable distances when thrown and which spins during flight. A typical flying saucer toy is disclosed in U.S. Pat. No. 3,359,678. To add interest to use of the toy and also to enhance location and recovery thereof, lights have been mounted on the saucer, usually at the periphery. Typical in such toys is the chemiluminescent system disclosed in U.S. Pat. No. 3,786,246; or the battery powered flashing light system described in U.S. Pat. No. 3,812,614. The latter patent describes a circuit in which light emitting diodes located on the saucer periphery flash at fixed time intervals. The circuit is designed so the flashes are intense but of short duration. The current wave form comprises alternate positive and negative spikes that exponentially decay to zero. The flash frequency is adjustable by a potentiometer in the circuit and, once set, remains constant whether or not the toy is in motion. The flash frequency is set at about midpoint of the anticipated range of rotational speed of the toy during flight. Lighting circuits have also been incorporated in spinning tops and include a normally open centrifugal switch that closes when rotation exceeds a predetermined minimum rate.

Although the above described lighted flying saucers are workable, they still present some shortcomings. The chemiluminescent system has the basic disadvantage that once actuated it cannot be deactivated hence simply stays on until exhausted. The continuously-on battery operated system can be turned on and off at will, but is just not very interesting. Moreover, it makes a continual draw on the battery. The light emitting diode system partially overcomes the low battery life problem but is not efficient as to light output for given power consumption. Moreover, light emitting diodes are availabe in only a few colors thus limiting their use as an identifier when a number of players are competing with lighted flying saucers.

RELATION TO CO-PENDING APPLICATION

My co-pending application discloses and claims a circuit in a flying saucer having one or more lamps connected into the circuit so that when the toy is at rest the lamps flash at preselected intervals for a preselected duration and when the toy is rotating above a predetermined rate, the flash interval decreases so the visible flash rate increases. The flash duration remains essentially unchanged.

In the embodiment claimed in said earlier application a unique circuit changes the flash interval. The circuit includes a normally open resistive switch that closes in response to rotation of the toy thereby to insert in the circuit a resistance in parallel to the existing resistance so that the total resistance controlling flash interval is reduced with a consequent reduction in flash interval.

In most cases, when an on-off switch fails, it fails in the open or off mode. This may be due to dirt, damage or other malfunction, but, whatever the reason, the result is that the lamps flash only at the lowest rate. This detracts from pleasure in use of the toy. Thus, in my said co-pending application Ser. No. 373,427, if the centrifugal switch fails to close, the toy will flash only at the lower rate.

The present invention, on the other hand, provides a unique flash-interval control circuit that includes a normally closed switch which, when closed, connects the lamp in a circuit that flashes it at one fixed rate and, when open, modifies the circuit to reduce the flash interval thus increasing the flash rate. If the switch should fail "open", the circuit will stay in the fast flash mode which is desirable.

SUMMARY OF THE INVENTION

It is the primary object of this invention to provide a control circuit and lighting system for use on rotatable toys such as flying saucers that is low in power consumption yet provides flashing lamps to increase interest in play.

Another object is the provision of a circuit of the type described by which, when the toy is at rest, the lamps flash at a relatively low frequency, when the rotation is above a selected rate a normally closed switch opens effecting modification of the circuit to decrease flash interval (increase flash rate); and when rotation falls below the selected rate the normally closed switch re-closes and the lamps flash again at the initial low frequency.

A related object is the provision, in a lighting system of the type described, of means by which the output pulses are voltage regulated thus allowing the lamps to be of the incandescent type operating at a voltage which yields high light output for given power consumption.

A still further object of the invention is the provision of replaceable lens or filters covering the lamps thereby facilitating change of the color of the lamp flashes.

In accordance with this invention, the flash interval is controlled by a circuit which includes a plurality of capacitors, a branch line and a normally closed centrifugal switch. With the switch closed, the capacitors are connected to present maximum capacitance hence, longer flash interval; and when the switch opens the connection of capacitors changes to present reduced circuit capacitance and correspondingly reduced flash interval.

In the preferred embodiment, the invention includes a flying saucer, one or more incandescent lamps, desirably at or adjacent the saucer rim, a battery, preferably at the central axis of the saucer, and a solid state circuit connecting the battery and lamps, said circuit including an astable multivbrator circuit, a primary switch connecting the battery to the circuit to effect flashing of the lamps, and a secondary switch that is normally closed but which opens when the toy spins faster than a preselected rate and which, upon opening, reduces effective capacitance in the part of the astable multivibrator circuit that controls flash interval. The result is to decrease capacitor charge time and thus flash interval.

The astable multivibrator circuit includes a readily available integrated circuit NE555, with resistors and capacitors connected to determine the capacitor charge rate (flash interval) and discharge rate (flash duration). Voltage to the lamps is controlled by a transistor, a zener diode and a resistor.

The invention presents a unique circuit for effecting an increase in pulse or lamp flash rates when the toy is spun at a sufficient rate to open the normally closed secondary switch. When this switch is in the normal closed position, the capacitance in the circuit is maximum. When the switch opens, the circuitry of the capacitors is changed to reduce capacitance. The result is a decrease in the capacitor charge time and of the flash interval. Only the capacitors in the flash interval circuit are changed so the flash duration is unchanged.

Because of the characteristics of the complete circuit of the invention, very little average current is required to change the charge time (flash interval) thus enabling the use of a light, inexpensive secondary switch.

Another feature of the invention provides lens holders on the saucer so that removable filters or lenses of various colors can be inserted over the lamps to provide infinite color choices without changing lamps.

The physical components may be mounted in any convenient manner on the saucer to best distribute weight without detracting from flight characteristics. The battery which is quite heavy is best placed in the center.

In order that the invention may be better understood and carried into effect, reference is made to the accompanying drawings and description thereof which are offered by way of example only and not in limitation of the invention the scope of which is defined by the appended claims including equivalents of components embraced therein.

DESCRIPTION OF PREFERRED EMBODIMENT

Figure 1:
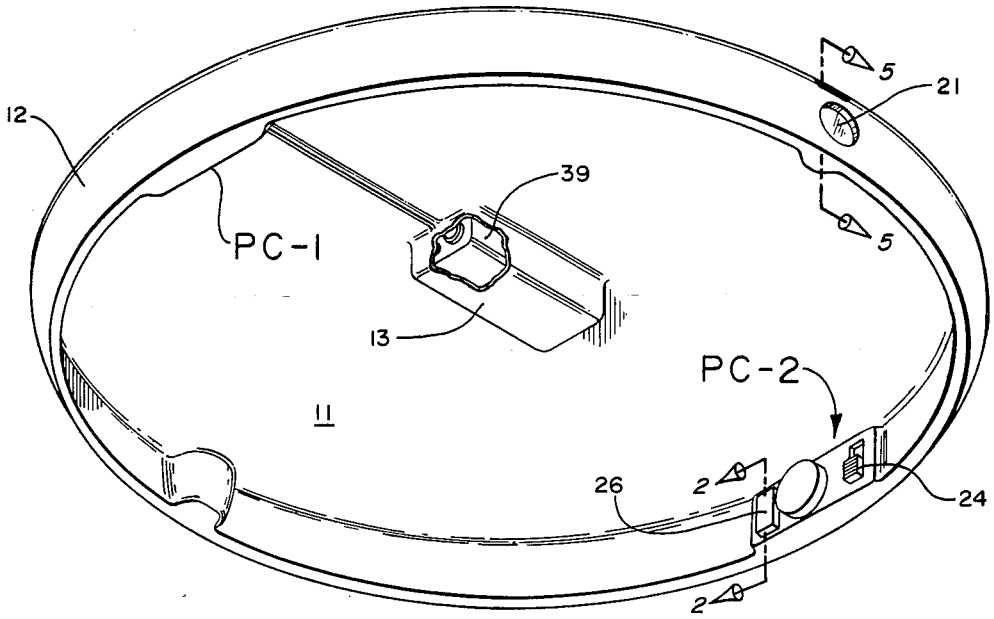
FIG. 1 is a perspective view of a flying saucer toy embodying the invention.

As illustrated in FIG. 1, the flying saucer is of usual construction comprising a domed top 11 turning down at its outer edge into a peripheral skirt 12. A central pocket 13 is molded into the top to hold a battery, typically 9 volt, alkaline, that will be connected into the circuit.

Figure 5:
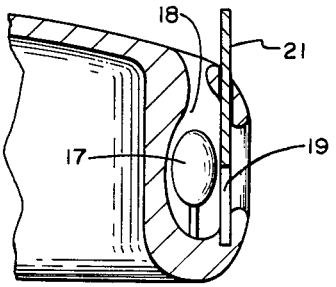
FIG. 5 is a section taken in the plane of line 5—5 of FIG. 1 looking in the direction of arrows 5.

As best illustrated in FIG. 5, tiny incandescent lamps 17 are secured in pockets 18 specially formed in the skirt. And to provide maximum flexibility in color selection, each pocket is provided with grooves 19 for receiving a replaceable lens 21 of selected color.

The entire circuit, other than battery and some conductors, is located on the inside wall of the skirt 12. In the illustrated embodiment, parts of the circuit have been assembled on two separate printed circuit boards, shown in FIG. 1 as components PC-1 and PC-2, mounted on opposite sides of the saucer and functionally connected by suitable conductors.

The circuit is provided with a primary on-off switch 24 and also a normally-closed secondary switch 26 both of which are mounted on the inside skirt wall. The secondary switch S2 is a normally closed switch that opens in response to rotation of the saucer above a pre-determined rate.

Figure 2:
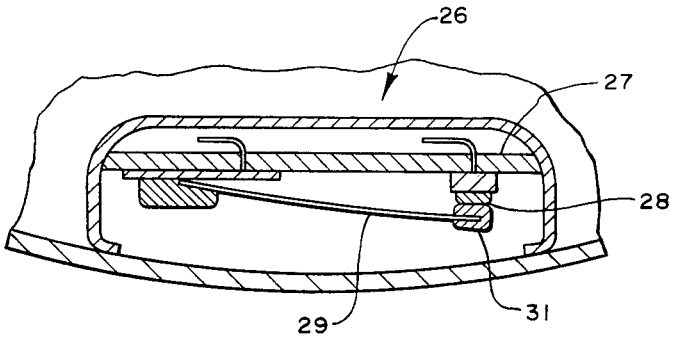
FIG. 2 is a sectional view taken in the plane of line 2—2 of FIG. 1 looking in the direction of arrows 2 and illustrates a preferred form of normally-closed centrifugal switch that opens when the toy spins.

FIG. 2 illustrates a preferred embodiment of a secondary switch that is opened by spinning the toy. This switch, referred to as a centrifugal switch, includes a base 27 of non-conductive material with a conductive contact point 28 secured thereto. The base is mounted inboard of and facing the skirt. A conductive spring member 29 with a contact point 31 is separately mounted on the base with the contact point spring biased into engagement with the contact point on the base. The contact point 31 and spring 29 are selected so that upon rotation of the saucer the forces generated will overcome the spring bias and force the contact point 31 out of engagement with the contact point 28 thus opening the switch. The switch is connected in the circuit as secondary switch S2 as hereinafter described in connection with the circuit diagrams of FIGS. 3 and 4.

Figure 3:
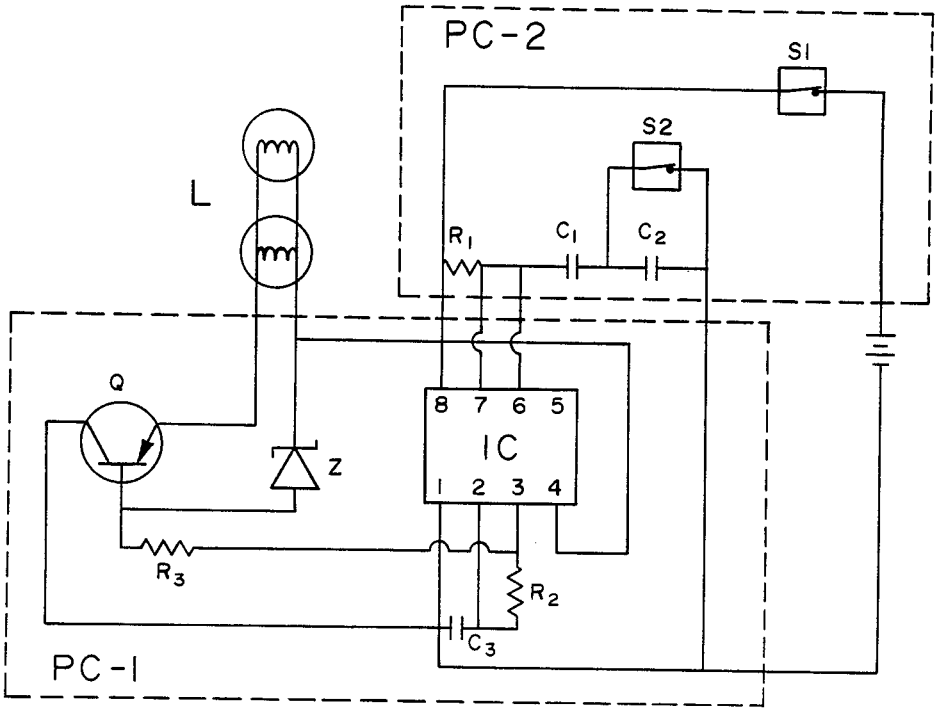
FIG. 3 is a diagram of the circuit embodying the invention.

The electronic circuit of the invention is illustrated in FIG. 3. The circuit includes a battery with suitable conductors connected respectively to the positive and negative terminals thereof. A single-pole single-throw master switch S1 is connected in one conductor. Beyond the master switch S1, the system includes an astable multivibrator circuit comprised of an integrated circuit chip IC, resistors R1 and R2, and capacitors C1, C2 and C3. The multivibrator circuit pulses as a rate and duration established by the integrated circuit in cooperation with such resistors and capacitors. Voltage is maintained by a zener diode Z in combination with a resistor R3. A transistor Q is utilized as a driver for supplying current to one or more incandescent lamps L. The circuit so far described is functional when the master switch S1 and secondary switch S2 are both closed as when the toy is at rest.

Initially, when the master switch S1 and capacitive switch S2 are first closed all capacitors are uncharged, there are negative inputs at pins 2 and 6 of the IC and pin 3 thereof is positive. Pin 3 charges capacitor C3 through resistor R2 and capacitor C1 is charged through a resistor R1. Since secondary switch R2 is closed, the capacitor C2 has been bypassed. In the IC, the voltage on pin 3 remains high causing the lamps L to remain off until voltage on pin 6 reaches two thirds of the battery supply voltage whereupon the IC internal flip-flop resets causing the voltage on pin 3 to become negative and the lamps to turn on. At this same time, the IC rapidly discharges capacitor C1 and blocks recharging thereof until voltage at the IC pin 2 drops below one-third of battery voltage. Also, capacitor C3, which had been previously charged through the resistor R2 almost to full battery voltage, begins to discharge back through the same resistor (R3). When the voltage on IC pin 2 drops below one-third of the battery voltage, the IC flip-flop sets whereupon IC pin 3 becomes positive and the lights go off. The cycle then starts over and C1 starts to charge from R1.

In the circuit described, the flash duration (on-time) is equal to the time required for capacitor C3 to discharge through resistor R2 from full battery voltage down to about one-third thereof. The interval between flashes (flash interval) is the time needed to charge capacitor C1, through resistor R1, from zero voltage to two-thirds of battery voltage.

When the saucer is spinning and secondary switch S2 opens, a second capacitor C2 is inserted in the circuit in series with the first capacitor C1 so that voltage through the resistor R1 charges both capacitors C1 and C2. The flash interval then becomes the time it takes to charge the series combination of the first and second capacitors, C1 and C2, from zero voltage to two-thirds of battery voltage. The capacitance of capacitors C1 and C2 in series is less than the capacitance of only the first capacitor C1 alone. Consequently, the charge time and resulting flash interval are reduced. In short, the centrifugal switch opens to reduce capacitance and thus reduce the interval.

In the embodiment illustrated in FIG. 3, when the capacitive switch S2 opens it reduces capacitance by inserting an additional capacitor C2 in series with an existing capacitor C1 in the voltage supply conductor.

Figure 4:
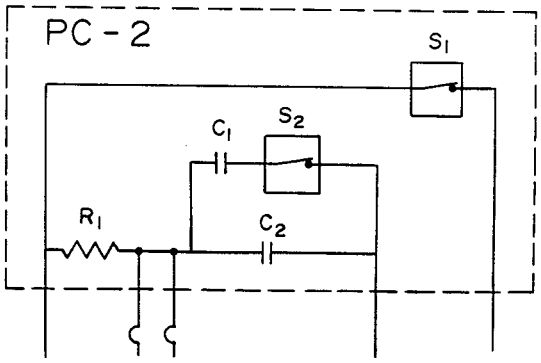
FIG. 4 is a circuit diagram showing a modified form of the circuit.

Another form of capacitive switch is illustrated in FIG. 4. In this circuit, when switch S2 is closed, two capacitors, C1 and C2, that control the flash interval are connected in parallel. When the centrifugal switch S2 opens, one of the capacitors is taken out of the circuit. This reduces capacitance and there is a proportionate decrease in the flash interval and increase in flash rate. In this circuit, the capacitance of capacitors C1 and C2 in parallel is greater than the capacitance of C2 alone.

In both of the illustrated embodiments, the on-time or flash duration remains unchanged.

Due to the high internal impedance of the integrated circuit and its associated components only a very low average current drive through the secondary switch S2 is needed to control the frequency and duty cycle of the astable multivibrator. This is an important feature of the invention because it enables the use of a light-weight, light-duty secondary switch S2.

A transistor Q in the circuit is the current amplifier for the output of the integrated circuit IC and, in conjunction with the zener diode, Z, forms an emitter-follower voltage regulator which regulates voltage across the lamps.

The circuit components may be spaced around the flying saucer as needed to achieve proper weight distribution. In one actual embodiment of the invention, the circuit, except for the lamps, battery and conductors was put on two separate circuit boards as indicated by dash lines labeled PC1 and PC2 in FIG. 3. The circuit boards were mounted on the saucer as indicated in FIG. 1. The conductors and lamps were positioned as needed to complete the circuit.

The flash interval can be changed by changing the values of resistor R1 and/or the capacitors C1 and C2. Although the invention has beed described in connection with a toy flying saucer, it may be used with tops or other rotating devices.

The entire circuitry of the IC NE555 has not been illustrated in detail because such an explanation is unnecessary to an understanding of the invention. However, all details of the IC can be derived by reference to pages 9–29 through 9–34 of the Linear Data Book 1980, by National Semiconductor Corp. Such publication is incorporated herein by reference.

It will be appreciated that the entire circuit is especially adapted to the use of incandescent lamps operating at a voltage which yields high light output for given power consumption. This is achieved by connecting the astable multivibrator circuit output through a third resistor R3 to the base of an emitter follower circuit and to a zener diode which is in turn connected to the positive or negative voltage supply rails.

I claim:

1. In a toy of the type having a body rotatable about a central axis and at least one lamp with battery and associated circuit to flash the lamp at a first interval for a fixed duration when the toy is at rest and to decrease the flash interval when the toy rotates above a certain rate the improved circuit comprising a solid state astable multivibrator circuit adapted when closed to generate pulses to light said lamps for predetermined on times and intervals, said circuit including a first resistor, a first capacitor and a second capacitor connected in said circuit so that said first resistor and said first and second capcitors determine said interval, a normally closed switch which when closed presents maximum designed capacitance to said circuit for controlling flash interval and when open presents reduced capacitance to said circuit for controlling flash interval, and means on said switch to effect opening of said switch when rotation of said toy exceeds a predetermined rate.

2. The lighting system circuit according to claim 1 in which said normally closed switch is arranged so that when closed it connects only said first resistor and said first capacitor into said circuit in series with each other and said second capacitor is bypassed and when said switch is opened, connection is effected of said second capacitor in series with said first capacitor.

3. A lighting system circuit according to claim 1 in which, when said normally closed switch is closed, said first and second capacitors are parallel to each other and at the same time both are separately connected in series with said first resistor; and when said normally closed switch is open one of said capacitors is disconnected from said circuit.

4. A lighting system circuit according to claim 1 in which said normally closed switch is located at the periphery of said toy and includes a rigidly mounted first contact, a second contact that is spring biased into engagement with said first contact and said spring biased second contact is positioned so that upon rotation of said toy faster than a predetermined rate, said second contact is centrifugally urged out of engagement with said first contact thereby to open said switch.

5. A circuit for flashing lamps on a rotatable toy comprising, lamps, a battery, and an integrated circuit with resistors and capacitors cooperative therewith to flash said lamps at fixed intervals for a fixed time, said circuit being arranged so that said intervals are controlled by a first resistor and at least first and second capacitors that are charged through said resistor, and a normally closed capacitive switch which, when closed, connects said capacitors to define a first capacitance to be charged through said first resistor and which, when open, defines a relatively reduced capacitance to be charged through said first resistor; and means on said normally closed capacitive switch to open the same when said toy spins faster than a predetermined rate.

6. A circuit according to claim 5 in which when said capacitive switch is closed one of said capacitors is bypassed and when said capacitive switch is open said first and second capacitors are in series.

7. A circuit according to claim 5 in which when said capacitive switch is closed said first and second capacitors are parallel to each other and in series with said first resistor and when said capacitive switch is open one of said capacitors is disconnected from the circuit.

* * * * *